US007213680B1

(12) United States Patent
Franklin

(10) Patent No.: US 7,213,680 B1
(45) Date of Patent: May 8, 2007

(54) ACOUSTICAL WALL COVERING ASSEMBLY PLEATED AND SECURED IN SITU FOR COVERING WALLS IN MOVIE THEATRES AND METHOD

(75) Inventor: Patricia Franklin, Celebration, FL (US)

(73) Assignee: Franklin Designs, Inc., Jackson, MS (US)

( * ) Notice: Subject to any disclaimer, the term of this patent is extended or adjusted under 35 U.S.C. 154(b) by 257 days.

(21) Appl. No.: 10/842,082

(22) Filed: May 10, 2004

Related U.S. Application Data

(63) Continuation-in-part of application No. 10/293,851, filed on Nov. 12, 2002, now abandoned.

(51) Int. Cl.

| | |
|---|---|
| ***E06B 3/48*** | (2006.01) |
| ***E06B 9/06*** | (2006.01) |
| ***E06B 9/56*** | (2006.01) |
| ***A47H 13/14*** | (2006.01) |
| *E04B 1/99* | (2006.01) |
| *A47H 13/16* | (2006.01) |

(52) U.S. Cl. ..... 181/30; 160/348; 160/327; 160/370.23; 160/84.03

(58) Field of Classification Search ..... 181/30, 181/290, 295, 296, 287; 160/348, 327, 328, 160/368.1, 349.1, 370.23, 84.01, 84.03; 52/144, 52/145

See application file for complete search history.

(56) References Cited

U.S. PATENT DOCUMENTS

| | | | | |
|---|---|---|---|---|
| 1,017,754 | A * | 2/1912 | Hart | 24/302 |
| 2,126,834 | A * | 8/1938 | Steinberger | 160/348 |
| 2,474,552 | A * | 6/1949 | Steinmeyer | 160/348 |
| 2,522,358 | A | 9/1950 | Franson et al. | 160/348 |
| 2,557,578 | A * | 6/1951 | Stallone | 160/348 |
| 2,595,549 | A | 5/1952 | Sherman | 2/278 |
| 2,609,873 | A | 9/1952 | Falkenberg | 160/348 |
| 2,623,582 | A | 12/1952 | Handley | 160/348 |
| 2,710,653 | A * | 6/1955 | Solomon | 160/348 |
| 2,711,847 | A * | 6/1955 | Kessler | 223/30 |
| 3,001,578 | A * | 9/1961 | Ratliff | 160/126 |
| 3,011,174 | A | 12/1961 | Schaerer | 160/354 |
| 3,132,686 | A | 5/1964 | Judovits | 160/348 |
| 3,155,150 | A * | 11/1964 | Silvestre | 160/348 |
| 3,166,854 | A * | 1/1965 | Packer et al. | 33/664 |
| 3,255,809 | A * | 6/1966 | Kawczynski | 160/349.1 |
| 3,279,530 | A * | 10/1966 | Romano et al. | 160/348 |
| 3,369,303 | A * | 2/1968 | Henry | 33/563 |

(Continued)

*Primary Examiner*—Edgardo San Martin
(74) *Attorney, Agent, or Firm*—Baker, Donelson, Bearman, Caldwell & Berkowitz, PC

(57) ABSTRACT

An acoustical wall covering assembly (10) with pleats (11) formed and attached in situ to a trim member for covering a wall of a movie theatre, in which a panel (22) of an acoustical wall covering attaches to a pleating member (22) having groups (20) of scores (32, 34, 36, 38) for folding to define the pleats (11). An end of the pleated assembly (10) attaches to a ceiling trim (16). Each pleat (11) is formed and attached in situ to the ceiling trim. Subsequently, each pleat in the attached panel is pulled longitudinally away from the ceiling trim (16) to form an extended pleat in the panel and then secured to a bottom trim (18) to cover a portion of the wall with the pleated assembly. A method of forming and securing an acoustical pleated panel in situ to cover a wall is disclosed.

16 Claims, 4 Drawing Sheets

U.S. PATENT DOCUMENTS 3,399,713 A * 9/1968 Wilson ..... 160/348
3,441,077 A 4/1969 Romano ..... 160/348
3,454,203 A * 7/1969 Nelson ..... 223/34
3,654,983 A 4/1972 Hachtel ..... 160/348
3,683,994 A 8/1972 Eichenlaub ..... 160/327
3,712,520 A * 1/1973 Vipond ..... 223/34
3,741,259 A * 6/1973 Wood et al. ..... 139/387 A
3,774,666 A * 11/1973 Bunger ..... 160/348
3,807,482 A * 4/1974 Baker, Sr. ..... 160/330
3,948,307 A * 4/1976 Scholer ..... 160/348
3,974,946 A 8/1976 Gentry ..... 160/348
4,042,155 A * 8/1977 Sprong ..... 223/34
4,117,180 A * 9/1978 DeWoskin ..... 160/348
4,226,276 A 10/1980 Bressler ..... 160/348
4,230,171 A * 10/1980 Baker, Sr. ..... 160/84.01
4,269,880 A * 5/1981 Nalepka ..... 160/348
4,342,356 A 8/1982 Sickels et al. ..... 160/348
4,582,109 A * 4/1986 Fairbanks ..... 160/84.04
4,655,272 A 4/1987 Reilly et al. ..... 160/348
4,878,531 A 11/1989 Stover ..... 160/327
6,041,481 A * 3/2000 Martin ..... 160/348
6,336,493 B1 1/2002 Sickels ..... 160/327

* cited by examiner

ACOUSTICAL WALL COVERING ASSEMBLY PLEATED AND SECURED IN SITU FOR COVERING WALLS IN MOVIE THEATRES AND METHOD

The present application is a continuation-in-part of application U.S. Ser. No. 10/293,851, filed Nov. 12, 2002 now abandoned.

TECHNICAL FIELD

The present invention relates to methods for hanging acoustical wall coverings. More particularly, the present invention relates to apparatus and methods for preparing and hanging acoustical wall covering assemblies for sound dampening of movie theatres.

BACKGROUND OF THE INVENTION

Movie theatres provide viewers a facility for escape from everyday events. Movie theatres typically include large viewing screens for presentation of films ranging from drama, adventure, comedy, suspense and mystery, and other such fair. In addition to the visual presentation of the film, theatres also include powerful sound systems with amplifiers and speakers positioned within the auditorium of the theatre to enhance the visual effect of the film being shown.

Often the auditorium of the theatre is housed in buildings with high ceilings, which have broad wall surfaces extending from the screen to the back of the theatre past the many rows of seats. To accommodate the acoustical characteristics of movie theatres, the walls typically include dampening material as an exterior surface. The damping material absorbs the sound so that sound does not repeat and echo through the auditorium during the course of the film but rather the sounds of the continuing scenes may be clearly heard.

Typically, movie theatre interior walls are covered with drapery material placed as curtains along the walls of the theatre. The drapery material dampens the sound. A common drapery or curtain used in many theatres is pleated from the ceiling to about four to six feet off the floor. A carpet covers the lower portion of the wall. The pleated curtain provides not only the acoustic effect, but an ornamental appearance as well. Typically the drapery curtains on walls of theatres have four-inch box pleats at nine-inch spacing, extending from approximately four feet off the floor to the ceiling.

The labor to prepare, handle, and install drapery curtains in theatre interiors is significant. A special sewing shop is required. Large tables are necessary to receive the elongate sheets of drapery fabric. Typically the drapery fabric is provided in 54 inch widths. The length of the fabric is sufficient to extend between a ceiling trim near the ceiling and a wall trim vertically spaced from the floor. Often these lengths are 30 or 40 feet or more. The entire length of a fabric has to be pleated.

The drapery fabric is measured for length and cut from a bolt of fabric. The fabric then is laid on the table where the pleats are measured, marked with pens, and sewn across the top to form the pleat. A jute backing often is applied using a top and bottom stitch. The pleated length of fabric is then marked so that installers can identify the portion of the wall on which the pleated fabric drapery is to be installed. The completed drapery is packed and shipped to the job site. At the job site, workers unpack the boxes and install the drapery curtains in the appropriate sequence.

The measuring, cutting, and sewing is extensively labor intensive and time consuming. This results in significant costs associated with installing or replacing interior drapery treatments for movie theatres.

Accordingly, there is a need in the art for an improved method and apparatus of preparing and installing acoustical wall coverings for sound dampening of walls in movie theatres. It is to such that the present invention is directed.

BRIEF SUMMARY OF THE INVENTION

The present invention meets the needs in the industry by providing a method of forming a pleated panel of an acoustical wall covering and installing in situ on a wall in a movie theatre interior between opposing trims mounted to the wall in spaced relation, comprising the steps of:

(a) cutting a panel from a bolt of an acoustical wall covering to a selected length for extending between the spaced-apart trims;

(b) attaching a first end of the panel to adhesive-faced opposing sides of an elongate strip to form an acoustical wall covering assembly, said elongate strip defining a plurality of spaced-apart groups of spaced-apart scores;

(c) attaching a lateral end portion of the elongate strip to a ceiling support member; and (d) forming a pleat in the panel by folding the elongate member on the scores at each one of the group of scores while securing the formed pleat to the ceiling support member;

whereby the panel, being pleated and attached in situ to the ceiling trim, covers the wall.

In another aspect, the present invention provides an acoustical wall covering assembly formed with pleats and installed in situ on a wall of a movie theatre, comprising an elongate strip having a plurality of spaced-apart groups of spaced-apart scores for foldingly defining a pleat in the panel and an adhesive surface on opposing sides of the elongate strip. A panel of acoustical wall covering of a selected length attaches at a first end to the opposing sides of the elongate strip. Fasteners secure pleats to a ceiling trim member, which pleats are formed and attached in situ by folding the scores in each group of scores in the elongate strip and fastening to the trim member. The acoustical wall covering assembly defines a wall panel pleated and secured in situ by folding each group of scores to form respective pleats and securing the pleat to the ceiling trim member by the fasteners extending through the acoustical wall covering and the elongate strip on opposing longitudinal sides of each group, for in situ forming and attaching the pleated acoustical wall assembly to a ceiling trim mounted to a wall of a movie theatre.

Objects, features, and advantages of the present invention will be apparent upon reading the following detailed description in conjunction with reference to the appended drawings.

DETAILED DESCRIPTION

Figure 1:
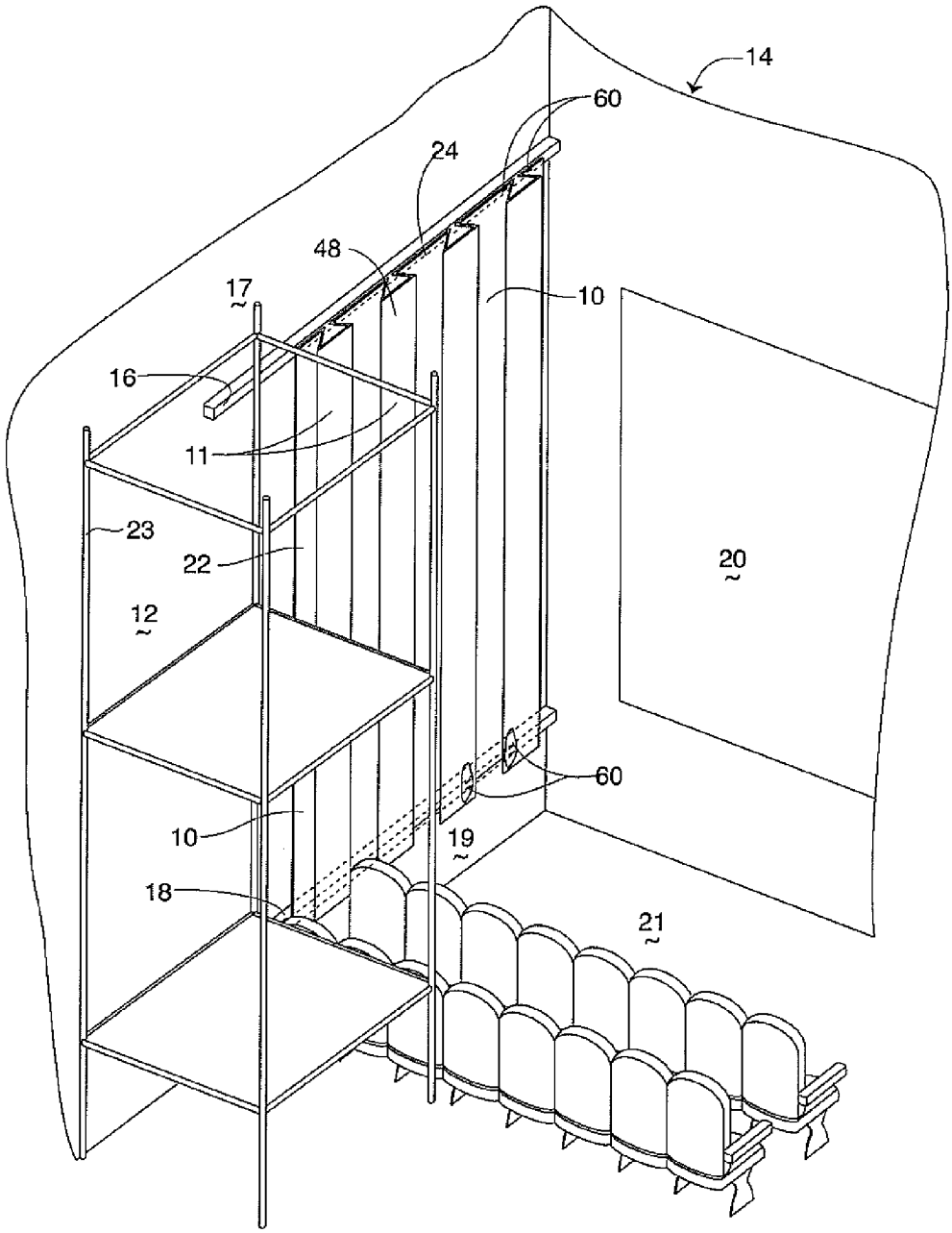
FIG. 1 is a pictorial cut-away view of a movie theatre in which an acoustic wall covering assembly according to the present invention is installed on a side wall.

Referring now in more detail to the drawings, in which like numerals indicate like parts throughout the several views, FIG. 1 illustrates in perspective view a pleated acoustic wall covering assembly 10 with spaced-apart pleats 11 formed in situ, according to the present invention, while the covering assembly 10 is being attached to a side wall 12 of a movie theatre generally 14 having an interior under construction or renovation. In the embodiment illustrated and described herein, the pleats 11 are box pleats, although one of ordinary skill in the art will readily appreciate upon reading of this disclosure that other pleat styles and spacings may be formed using the present invention.

As discussed below, the acoustical wall covering assembly 10 mounts to a ceiling trim 16 and a spaced-apart wall trim 18 during formation of the pleats, as discussed below. The trims 16, 18 are elongated wooden members, or other materials to which the assembly 10 attaches. The ceiling trim 16 attaches near a ceiling 17 of the movie theatre 14, as illustrated on the wall 12. The wall trim 18 is disposed intermediate a ceiling and a floor 21 of the theatre 14. A carpet 19 attaches to the wall to cover the wall between the wall trim 18 and the floor. The pleated acoustical wall covering assembly 10, attached to the side walls 12 of the theatre 14, dampens or attenuates sound emitted from speakers during viewing of a motion picture or film on a screen 20 in the auditorium of the movie theatre 14. Scaffolding generally 23 enables workers to reach the trim 16 during in situ formation and installation of the pleated acoustical wall covering 10.

Figure 2:
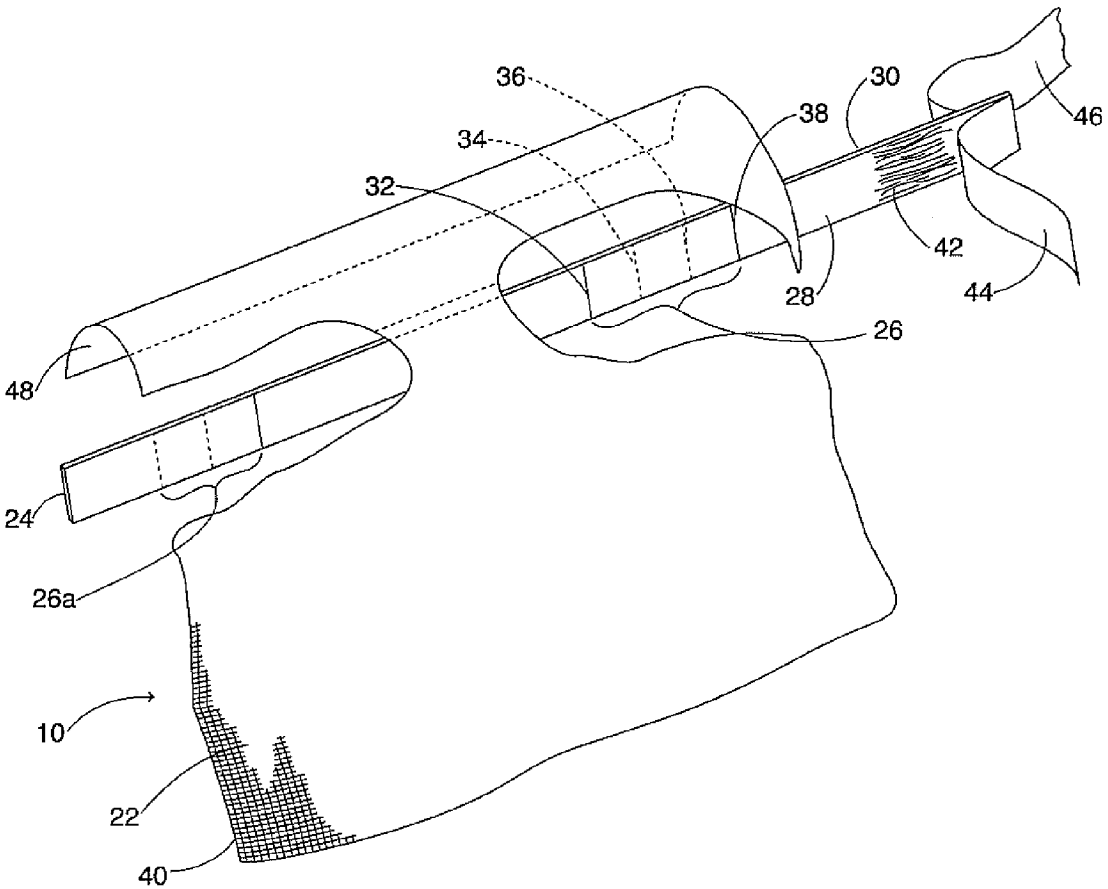
FIG. 2 is a perspective, partially cut-away view of an acoustic wall covering and pleating apparatus according to the present invention.

FIG. 2 is a cut-away view of a portion of the pleated acoustical wall covering assembly 10, prior to in situ formation and installation of pleats. The assembly 10 comprises an elongate panel 22 of acoustical wall covering material, such as a fabric or drapery material. The panel 22 attaches at a first end to an elongate pleating member 24. The pleating member 24 is an elongate strip having a plurality of spaced-apart groups 26 of spaced-apart scores to guide the formation of a pleat in the panel 22, as discussed below. Each group 26 includes scores on a front face 28 and a back face 30 of the pleating member 24. Each group 26 in the illustrated embodiment has a score sequence of a first front score 32, a first back score 34, a second back score 36, and a second front score 38. As discussed below, the pleating member 24 forms the box pleat by folding on the scores 32, 34, 36, and 38. Other score patterns define alternate styles of pleats known to those of skill in the art and are not further described.

The group 26 at the longitudinal distal ends of the pleating member 24 do not require a respective one of the front scores 32, 38. As illustrated in FIG. 2, the group 26*a* at a first distal end of the pleating member 24 lacks the first front score 32 at the distal edge of the pleating member 24. Likewise, although not illustrated, a group 26 at the opposing longitudinal distal end of the pleating member 24 would not include the second front score at the distal edge. These respective distal edges align with the lateral edges 40 of the panel 22.

The opposing front face 28 and back face 30 of the pleating member 24 include an adhesive coating 42. The adhesive coatings 42 are covered by cover sheets 44, 46 readily detached to expose the adhesive 42 when attaching the panel 22 to the pleating member 24, as discussed below. An edge portion generally 48 of the panel 22 attaches to the adhesive 42 on the back face 30 and overlaps to the front face 28, whereby the panel 22 is secured to the pleating member 24.

FIGS. 3A, 3B, 3C, and 3D illustrate steps in forming the box pleats 11 in the acoustical wall covering assembly 10 in situ while also attaching the assembly to the ceiling trim 16. The panel 22 in FIGS. 3A–3D is shown in partial cut-away view in order to illustrate features of the acoustical wall covering assembly 10 while the box pleats 11 are formed using the respective groups 26 of the scores 32, 34, 36, and 38.

Figure 3A:
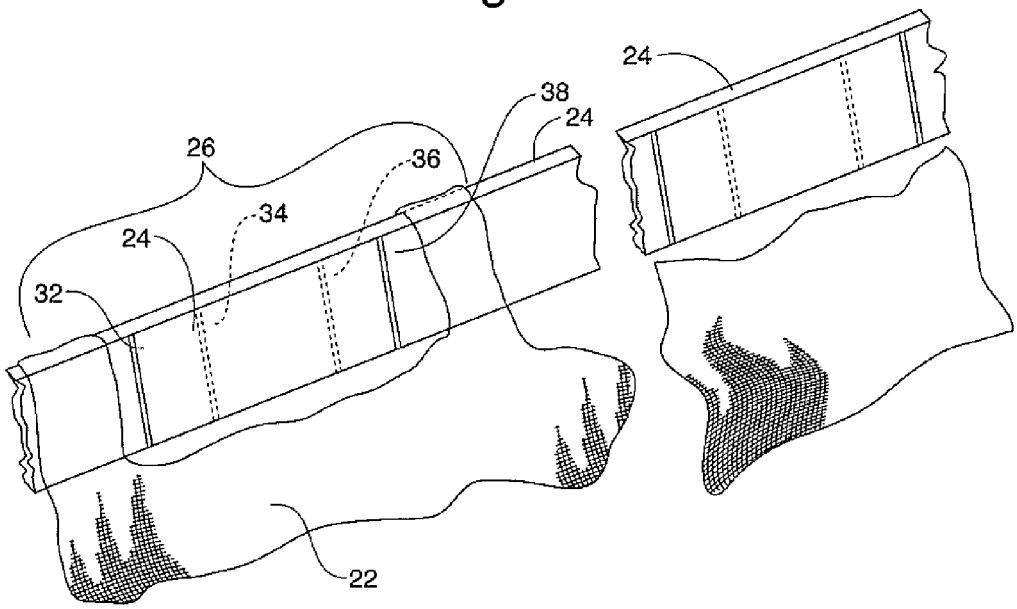
FIGS. 3A, 3B, 3C, and 3D illustrate the formation of the pleated wall covering assembly illustrated in FIG. 1.

The panel 22 is first cut from a bolt of the acoustical wall covering material. The panel 22 is cut to a selected length to extend between the spaced-apart ceiling trim 16 and wall trim 18, as illustrated in FIG. 1, plus sufficient overlap for the edge portion 48. It is to be appreciated that the ceiling trim 16 may be spaced from the ceiling leaving a gap that is covered by another material such as carpet The cover sheets 44, 46 (FIG. 2) are removed. With reference to FIG. 3A, the edge portion 48 of the panel 22 adheres to the adhesive 42 covering the back face 30, and overlaps and adheres to the front face 28 of the pleating member 24. The panel 22 may be placed on a table or other convenient work surface for securing the panel 22 to the pleating member 24.

Figure 3B:
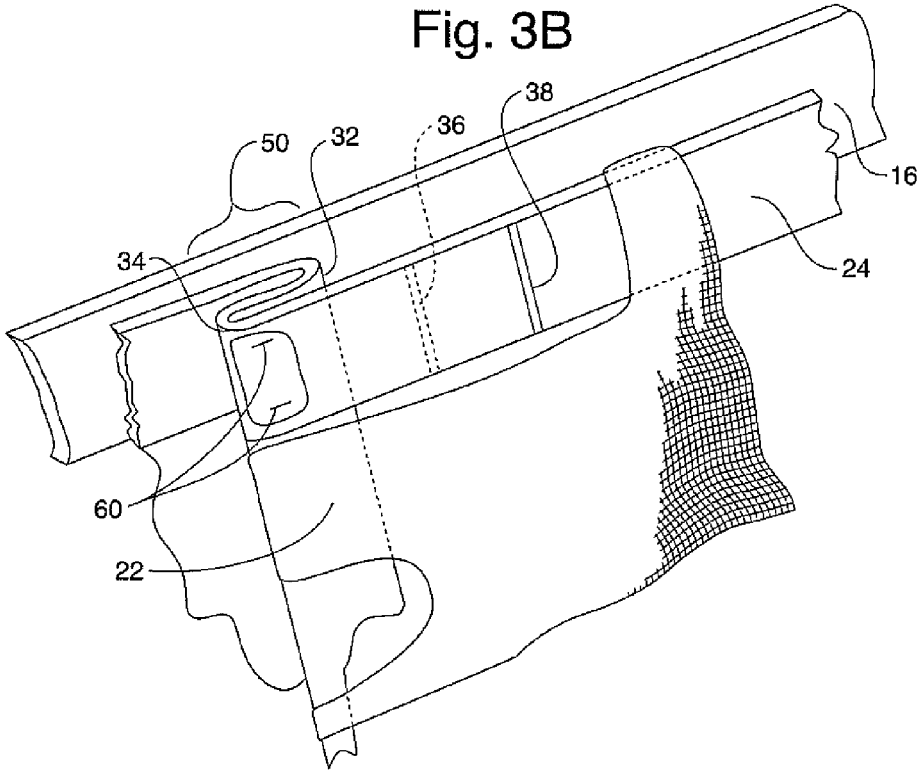

To form the box pleats 11 and attach to the wall in situ, the panel 22 with the panel 22 with the pleating member 24 is raised to the ceiling portion of the theatre, such as by using scaffolding 23 for workmen to stand while pleating and attaching the panel. A lateral side of the ceiling end of the panel 22 is attached with staples 60 to the ceiling trim 18. The first pleat is then formed by folding the panel on the scores 32, 34, 36, and 38 in the first group 26. With reference to FIG. 3B, the box pleat 11 is formed by first folding the pleating member to define a portion of a left side 50 of the box pleat. This is accomplished by folding the pleating member 24 on the score 32 forwardly to bring a lateral portion of the panel 22 foldingly over the remaining portion of the panel. A staple 60 through the fabric and the pleating member 24 attaches a first portion of the pleat to the ceiling trim.

The pleating member 24 is then reverse folded on the back score 34 to position the lateral portion of the panel 22 in overlapping relation. This results in a folded overlapping left side 50 of the box pleat 11.

Figure 3C:
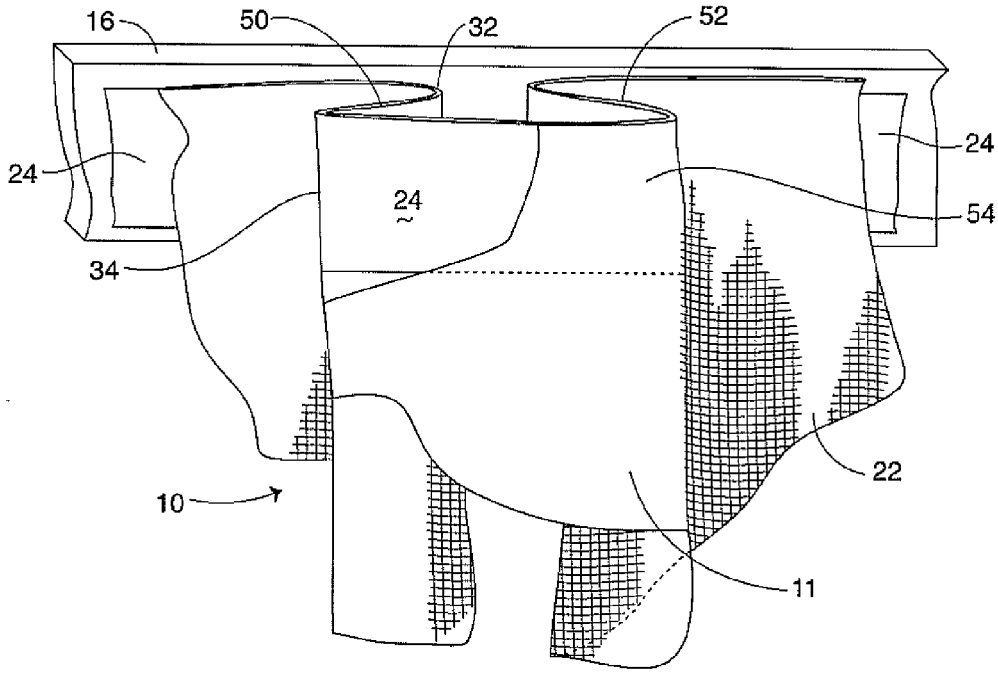
Figure 3D:
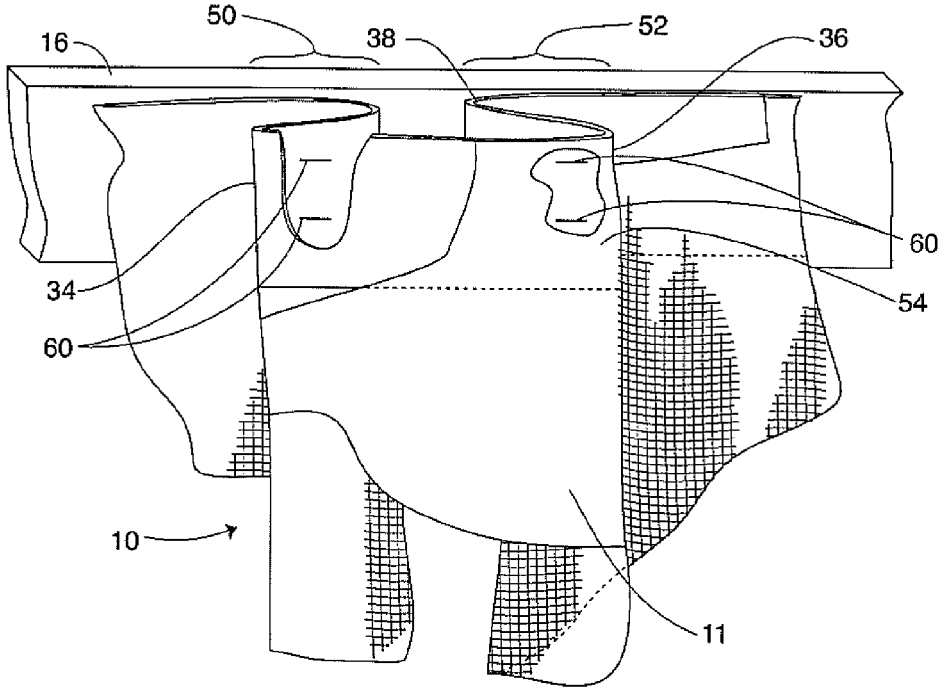

With reference to FIG. 3C, the pleating member 24 is reverse folded backwardly on the back score 36 to bring the right lateral portion of the panel 22 behind the pleat being formed. The right lateral portion of the panel 22 is then brought forward by folding the pleating member 24 on the forward score 38. This completes a right side 52 of the box pleat 11 and provides a bridging portion 54 between the folded scores 34 and 36 as illustrated in FIG. 3D. Staple 60 (or other fasteners) secures the right side 52 of the pleat 11 to the ceiling trim 16.

The folded overlapping left and right portions 50, 52 of the box pleat 11 are thereby formed and secured with respective staples 60 in situ. This process of forming and attaching the pleats 11 in the panel 22 in situ by folding the pleating member 24 and the attached panel 22 on the respective scores 32, 34, 36 and 38 in the groups 26 and attaching with staples 60 in situ is repeated. Each box pleat 11 formed with the scores in the respective group 26 are secured with staples 60, thereby attaching the panel 22 to the ceiling trim 16.

Upon completion of creating and securing the pleats in the edge portion of the panel 22, as discussed above, additional ones of the panels are pleated and secured in adjacent series to the ceiling trim 16, as described above, to cover the wall.

With reference to FIG. 1, the panels 22 across the wall 12 are then hanging free at the bottom. Each box pleat 11 in the panel 22 is then secured to the bottom wall trim 18. This is accomplished by grasping the panel 22 near the lower portion of the panel in alignment with a selected one of the box pleats 11. The selected box pleat 11 is pulled tight from the bottom portion longitudinally away from the first or ceiling end in order to provide substantially straight lines in the pleat in the panel between the ceiling and the floor. The box pleat 11 is thereby formed in the lower portion of the panel 22 and extending between the upper and lower portions of the panel 22. The resulting folded box pleat is secured in the lower portion by driving staples 60, or other fasteners suitable for securing fabric to the trim 16, 18, through the panel 22 into the wall trim 18. This is repeated for each of the box pleats 11 in the panel 22. Accordingly, each pleat 11 in each of the panels 22 is pulled longitudinally towards the wall trim 18 and secured to the wall trim to complete the pleat in the panel between the opposing first and second ends of the panel.

The present invention accordingly provides an apparatus for forming the pleated panel 22 of an acoustical wall covering in situ for installation on a wall of a movie theatre, with significantly less labor, time, and coordination. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A method of forming a pleated panel of an acoustical wall covering and installing in situ on a wall in a movie theatre interior between opposing trims mounted to the wall in spaced relation, comprising the steps of:

(a) attaching a first end of a panel portion of an acoustical wall covering to adhesive-faced opposing sides of an elongate strip to form an acoustical wall covering assembly, said elongate strip defining a plurality of spaced-apart groups of spaced-apart scores;

(b) attaching a lateral end portion of the elongate strip to a ceiling support member; and (c) forming a plurality of pleats in the panel by folding the elongate member on the scores at each one of the group of scores while securing the formed pleat to the ceiling support member, whereby the panel, being pleated and attached in situ to the ceiling support member and cut from the bolt, covers the wall.

2. The method as recited in claim 1, further comprising the steps of:

(d) pulling each pleat in the pleated panel longitudinally away from the ceiling end of the pleated panel; and (e) attaching a second portion of the pleated panel to a second support member mounted to the wall and vertically spaced from the ceiling support member, whereby the wall in the theatre is covered with the pleated panel.

3. The method as recited in claim 1, wherein step (c) involves folding scores defined in each group in a sequence of front score, back score, back score, front score, to form a box pleat.

4. The method as recited in claim 1, further comprising the step of repeating steps (a)–(c) for subsequent panels of the acoustical wall covering, until a selected portion of the wall in the movie theatre interior is covered with pleated acoustical wall covering panels.

5. A method of covering an interior wall of a movie theatre with an acoustical wall covering pleated and installed in situ between opposing spaced-apart ceiling and wall trims mounted to a wall at vertically spaced portions of the wall, comprising the steps of:

(a) cutting a panel of an acoustical wall covering material to a selected length for extending between the spaced-apart ceiling and wall trims;

(b) attaching a ceiling end of the panel to adhesive-faced opposing sides of a folding strip to form an acoustical wall covering assembly, said folding strip defining a plurality of spaced-apart groups of spaced-apart scores foldable to define a pleat in the panel;

(c) attaching a lateral side portion of the acoustical wall covering assembly to the ceiling trim;

(d) folding the folding strip along the pre-formed scores in a group to form a pleat in the acoustical wall covering assembly;

(e) securing the pleat at opposing longitudinal sides thereof to the ceiling trim to secure the pleated ceiling end portion of the acoustical wall covering assembly in place;

(f) repeating steps (d) and (e) for each group of scores in the width of the panel of the acoustical wall covering assembly to form a pleated panel;

(g) pulling each pleat in the pleated panel longitudinally away from the ceiling end of the pleated panel to define a pleat extending therein between the ceiling end and a bottom end of the pleated panel; and (h) securing the pulled pleat at bottom end of the panel to the wall trim.

6. The method as recited in claim 5, wherein the scores in each group define a sequence of front score, back score, back score, front score for folding in step (d) to define a box pleat.

7. The method as recited in claim 5, further comprising the step of repeating steps (a)–(h) for subsequent panels of the acoustical wall covering, until a selected portion of the wall in the movie theatre interior is covered with pleated acoustical wall covering panels.

8. The method as recited in claim 7, wherein the scores in each group define a sequence of front score, back score, back score, front score for folding in step (d) to define a box pleat.

9. An acoustical wall covering assembly formed with pleats and installed in situ on a wall of a movie theatre, comprising:

an elongate strip having a plurality of spaced-apart groups of spaced-apart scores for foldingly defining a pleat in the panel;

an adhesive surface on opposing sides of the elongate strip;

a panel of acoustical wall covering of a selected length attached at a first end to the opposing sides of the elongate strip; and fasteners to secure each group of scores in the elongate strip to a ceiling trim member, whereby the acoustical wall covering assembly defines an in situ pleated wall-covering panel by folding each group of scores to form respective pleats and securing the pleat to the ceiling trim member by the fasteners extending through the acoustical wall covering and the elongate strip on opposing longitudinal sides of each group, for in situ forming and attaching the pleated acoustical wall assembly to a ceiling trim mounted to a wall of a movie theatre.

10. The acoustical wall covering assembly as recited in claim 9, wherein each group of scores has a sequence of front score, back score, back score, front score, whereby folding the group on the scores forms a box pleat.

11. The method as recited in claim 4, further comprising the steps of:

(d) pulling each pleat in the pleated panel longitudinally away from the ceiling end of the pleated panel; and (e) attaching a second portion of the pleated panel to a second support member mounted to the wall and vertically spaced from the ceiling support member, whereby the wall in the theatre is covered with the pleated panel.

12. The method as recited in claim 11, further comprising the step of repeating steps (d) and (e) for each of the subsequent panels.

13. A method of covering an interior wall of a movie theatre with an acoustical wall covering pleated and installed in situ between opposing spaced-apart ceiling and wall trims mounted to a wall at vertically spaced portions of the wall, comprising the steps of:

(a) attaching a ceiling end of a panel portion of a roll of acoustical wall covering to an adhesive-faced side of a folding strip to form an acoustical wall covering assembly, said folding strip defining a plurality of spaced-apart groups of spaced-apart scores foldable to define a pleat in the panel;

(b) attaching a lateral side portion of the acoustical wall covering assembly to a ceiling trim;

(c) folding the folding strip along one of the pre-formed scores in one of the groups to form a portion of a pleat in the acoustical wall covering assembly; and (d) securing the portion of the pleat to the ceiling trim;

(e) repeating steps (c) and (d) for each group of scores in the width of the panel of the acoustical wall covering assembly to form a pleated panel and to secure the pleated ceiling end portion of the acoustical wall covering assembly in place;

(f) pulling each pleat in the pleated panel longitudinally away from the ceiling end of the pleated panel to define a pleat extending therein between the ceiling end and a bottom end of the pleated panel; and (g) securing the pulled pleat at bottom end of the panel to the wall trim, whereby a portion of the wall in the movie theatre is covered with the pleated panel.

14. The method as recited in claim 13, wherein the scores in each group define a sequence of front score, back score, back score, front score for folding in step (c) to define a box pleat.

15. The method as recited in claim 5, further comprising the step of repeating steps (a)–(g) for subsequent panels of the acoustical wall covering, until a selected portion of the wall in the movie theatre interior is covered with pleated acoustical wall covering panels.

16. The method as recited in claim 15, wherein the scores in each group define a sequence of front score, back score, back score, front score for folding in step (c) to define a box pleat.

* * * * *